US005766646A

United States Patent [19]

Geus et al.

[11] Patent Number: 5,766,646

[45] Date of Patent: Jun. 16, 1998

[54] APPARATUS FOR MAKING A FLEECE FROM CONTINUOUS THERMOPLASTIC FILAMENTS

[75] Inventors: Hans Georg Geus, Niederkassel; Detlef Frey, Troisdorf; Bernd Kunze, Hennef, all of Germany

[73] Assignee: Reifenhauser GmbH & Co. Maschinenfabrik, Troisdorf, Germany

[21] Appl. No.: 659,039

[22] Filed: Jun. 3, 1996

[30] Foreign Application Priority Data

Jun. 13, 1995 [DE] Germany ..... 195 21 466.8

[51] Int. Cl.[6] ..... D01D 5/092

[52] U.S. Cl. ..... 425/72.2; 264/168; 264/210.8

[58] Field of Search ..... 264/168, DIG. 75, 264/40.3, 103, 210.8; 425/7, 72.2; 432/59

[56] References Cited

U.S. PATENT DOCUMENTS

| | | | |
|---|---|---|---|
| 362,260 | 4/1887 | Egger et al. | 425/72.2 |
| 2,437,263 | 3/1948 | Manning | 264/115 |
| 3,334,161 | 8/1967 | DeGuzman . | |
| 3,436,792 | 4/1969 | Hench | 425/7 |
| 4,145,203 | 3/1979 | Levecque et al. | 425/7 |
| 4,557,689 | 12/1985 | Krenzer | 432/59 |
| 4,820,142 | 4/1989 | Balk . | |
| 4,820,459 | 4/1989 | Reifenhauser | 264/40.3 |
| 5,032,329 | 7/1991 | Reifenhauser . | |
| 5,173,310 | 12/1992 | Katou et al. | 425/72.2 |
| 5,262,110 | 11/1993 | Spaller, Jr. et al. | 425/72.2 |
| 5,336,071 | 8/1994 | Kobayashi et al. | 425/72.2 |
| 5,433,591 | 7/1995 | Zingsem et al. | 425/72.2 |
| 5,439,364 | 8/1995 | Gerking et al. | 425/72.2 |
| 5,460,500 | 10/1995 | Geus et al. | 425/72.2 |

FOREIGN PATENT DOCUMENTS

| | | | |
|---|---|---|---|
| 1760483 | 4/1971 | Germany . | |
| 195 04 953 | 8/1996 | Germany . | |
| 0533304 | 2/1941 | United Kingdom | 425/72.2 |

*Primary Examiner*—Jay H. Woo
*Assistant Examiner*—Minh-Chau T. Pham
*Attorney, Agent, or Firm*—Herbert Dubno; Andrew Wilford

[57] ABSTRACT

A fleece-making apparatus has a vertically extending and horizontally elongated process shaft having upper and lower ends, a nozzle head at the upper shaft end for emitting a multiplicity of continuous thermoplastic strands that descend in the shaft as a curtain, and a foraminous conveyor belt at the lower shaft end for receiving and conveying away the filaments. A main stream of air flows downward in the shaft from the upper shaft end to the lower shaft end and through the belt for cooling and stretching the filaments and depositing the filaments on the belt. A pair of horizontally elongated and downwardly open second inlet slots flank the curtain of filaments below the upper shaft end, a pair of horizontally elongated third inlet slots flank the curtain of filaments below the second slots, and a pair of horizontally elongated third outlet slots flank the curtain of filaments below the third inlet slots and above the lower end. A controller including at least one blower connected to the slots directs second streams of air downward into the shaft from the second inlet slots, introduces third streams of air into the shaft through the third slots, and withdraws air from the passage through the third outlet slots for looping the cooled and stretched filaments prior to deposition on the belt.

6 Claims, 3 Drawing Sheets

APPARATUS FOR MAKING A FLEECE FROM CONTINUOUS THERMOPLASTIC FILAMENTS

FIELD OF THE INVENTION

The present invention relates to making a fleece from continuous thermoplastic filaments. More particularly this invention concerns an apparatus for making such a fleece.

BACKGROUND OF THE INVENTION

As described in commonly owned U.S. Pat. Nos. 4,820,142 and 5,032,329 and 4,340,563 an apparatus for making a continuous thermoplastic fleece comprises a spinning nozzle system or spinneret, a processing column and a continuously moving filament-receiving conveyor. The processing column includes a blowing or cooling shaft, a stretching gap, and a diffuser shaft. Process air is fed to the cooling shaft and is drawn out through the mat-receiving conveyor. The cooling shaft has a shaft wall provided with a plurality of air orifices and the process air required for cooling is introduced through the air orifices to provide an air flow in the shaft that is at least partially drawn out through the mat-forming conveyor.

With this equipment molten hot plastic is received from the extruder by the spinnerets which extrude it as thin molten streams and these streams are cooled and cured in the blowing or cooling shaft to produce stretchy but relatively thick filaments. These filaments are then stretched in the gap and then blown about in the diffuser shaft to form them into loops, and finally they deposit as a fleece-forming mat on the continuously moving conveyor. The process takes place vertically, with the spinnerets emitting the molten streams downward and the various other stages succeeding each other one below the next, with the conveyor at the bottom of the stack.

In copending application Ser. No. 08/597,016 filed 5 Feb. 1996 such an arrangement is shown where the filaments descend as a curtain in a main downwardly moving air flow and, after some cooling and stretching, more process air is introduced into the process shaft via a pair of horizontally elongated slot nozzles horizontally flanking the curtain of partially cured and stretched filaments. Thus as the filaments enter a lower diffuser zone of the process shaft they are buffeted by the air streams so as to form as a stochastic jumble on the foraminous conveyor belt. The filaments typically bond together where they cross and form a structurally stable spun-bond fleece that can be further compressed between rollers and that is suitable for use as diaper or filter material.

The action of the moving air on the descending filaments causes them to move stochastically, creating a random jumble that forms the desired mat. The amount the filaments are jumbled determines the so-called mesh width of the fleece. The frequency and amplitude of the oscillations created in the filaments determine this parameter.

OBJECTS OF THE INVENTION

It is therefore an object of the present invention to provide an improved fleece-making apparatus.

Another object is the provision of such an improved fleece-making apparatus which overcomes the above-given disadvantages, that is which produces a fleece of extremely uniform density and mesh size.

SUMMARY OF THE INVENTION

A fleece-making apparatus has according to the invention a vertically extending and horizontally elongated process shaft having upper and lower ends, a nozzle head at the upper shaft end for emitting a multiplicity of continuous thermoplastic strands that descend in the shaft as a curtain, and a foraminous conveyor belt at the lower shaft end for receiving and conveying away the filaments. A main stream of air flows downward in the shaft from the upper shaft end to the lower shaft end and through the belt for cooling and stretching the filaments and depositing the filaments on the belt. A pair of horizontally elongated and downwardly open second inlet slots flank the curtain of filaments below the upper shaft end, a pair of horizontally elongated third inlet slots flank the curtain of filaments below the second slots, and a pair of horizontally elongated third outlet slots flank the curtain of filaments below the third inlet slots and above the lower end. A controller including at least one blower connected to the slots directs second streams of air downward into the shaft from the second inlet slots, introduces third streams of air into the shaft through the third slots, and withdraws air from the passage through the third outlet slots for looping the cooled and stretched filaments prior to deposition on the belt.

The invention is based in the recognition that in order to achieve a uniform filament density and a so-called homogenous mesh size it is necessary to evenly distribute the filaments in the descending air/filament column over the entire cross-sectional area of the process shaft, in particular adjacent its walls. The invention deals with the boundary effect which creates disturbances in the otherwise uniform distribution of filaments in the process shaft. A particular problem is that the filaments contact and can even stick to the inside surfaces of the shaft walls. The invention prevents this aerodynamically by establishing a boundary-air flow layer that completely avoids such contact while ensuring that the filaments remain uniformly distributed in the process shaft, even as they are jumbled and looped.

It is a relatively simple matter to provide the system of this invention as a retrofit on an existing piece of equipment, to increase the quality of the fleece that is created. The air flow for the third slots can be tapped off the existing air-circulating system or a separate recirculating blower arrangement can be provided for them.

According to a feature of the invention the shaft has below the third outlet slots a downwardly widening diffusor region. The passage has side walls and the third outlet slots open transversely into the shaft at the side walls so that a boundary layer of air is withdrawn through the third slots.

According to yet another feature of this invention the passage has side walls provided with inwardly projecting flow deflectors. In addition the passage has end walls bridging the side walls and provided with further such inwardly projecting flow deflectors. The flow deflectors are formed as short cylindrical bumps.

The controller further includes variable flow-obstructing vanes in the third slots for controlling flow therethrough. Thus it is possible to adjust the flows for almost perfectly uniform density in the finished product.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
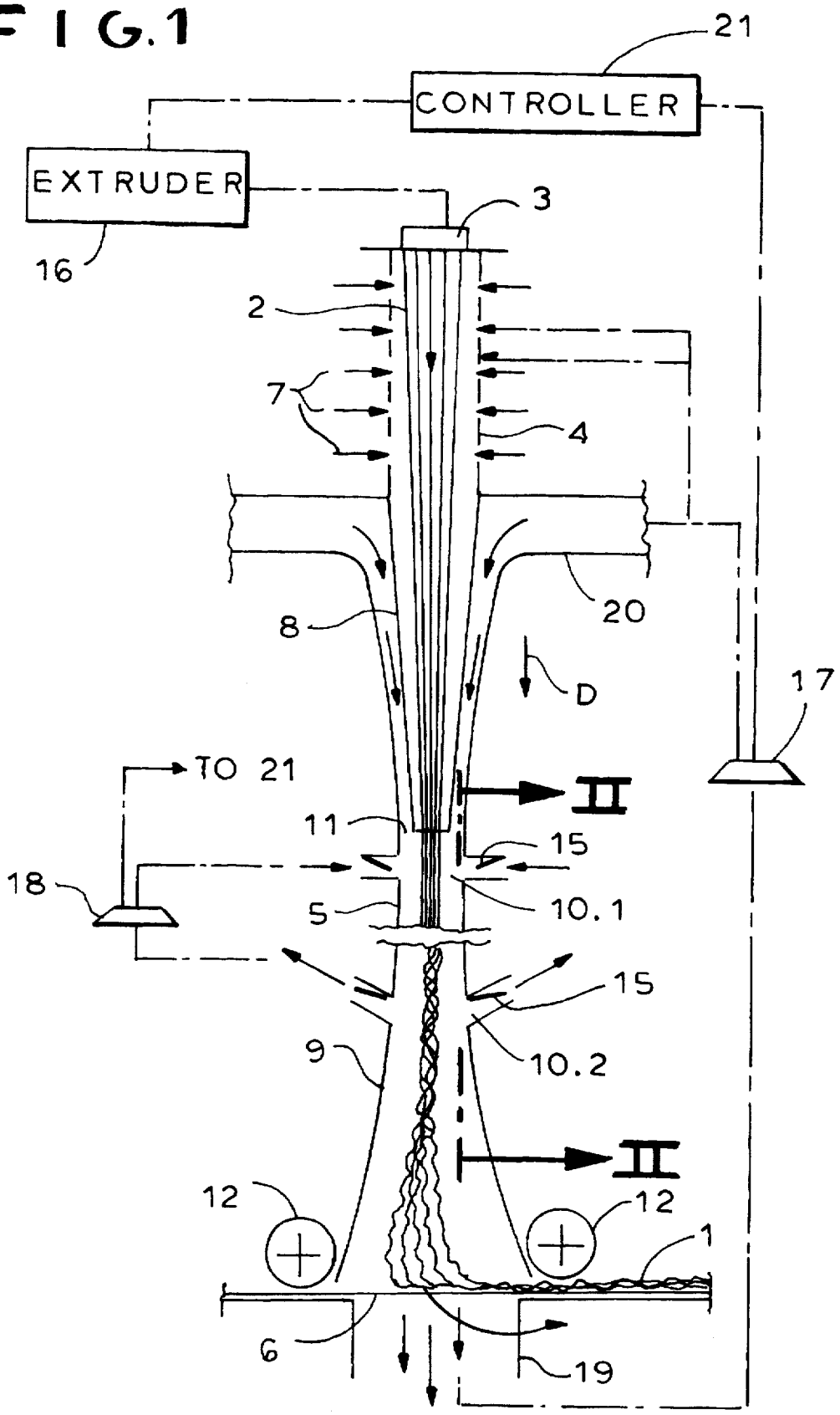
FIG. 1 is a small scale partly diagrammatic side view of the apparatus according to the invention.

As seen in FIG. 1 an apparatus for making spun bond, that is a fleece 1 made of endless thermoplastic filaments 2, has a spinneret 3 that receives molten plastic from an extruder 16. The filaments 2 from the spinneret 3 descend as a curtain elongated in a direction perpendicular to the view plane of FIG. 1 in a vertical process shaft 4, moving downward as indicated by arrow D. At the bottom of the shaft 4 the filaments 2 come to rest on a foraminous belt 6 which transports them out laterally and that is sealed with respect to the shaft 4 by rollers 12 one of which can also serve to compress the spun-bond fleece 1.

Inside the process shaft 4 the initially molten filaments 2 are subjected to the standard treatments of cooling, stretching, and looping before they land on the belt 6. To this end the upper end of the shaft has inner slot-forming elements defining a narrow passage 8 whose upper end is formed with air inlets 7 and whose lower end opens downwardly as a slot in the direction D slightly above a central region of the shaft 4 where it is of narrowest width, measured horizontally perpendicular to its horizontal elongation. A blower 17 has an inlet 19 underneath the belt 6 at the lower end of the shaft 4 and an outlet connected to the inlet ports 7 so that a constant stream of downwardly flowing air codirectional with the descending filaments 2 is formed in the shaft 4 as is standard. In addition more air is fed into the shaft 4 to either side of the passage 8 from inlet ports 20 to emerge from slots 11 flanking this passage 8 and extending the full horizontal length of the shaft 4. The downwardly flowing air in the passage 8 from the blower 17 serves to cool, and thereby cure, and to longitudinally stretch the filaments 2 while the air issuing from the slots 11 creates turbulence that loops the filaments 2 in a downwardly flared lower diffuser zone 9. All this is generally standard.

Figure 2:
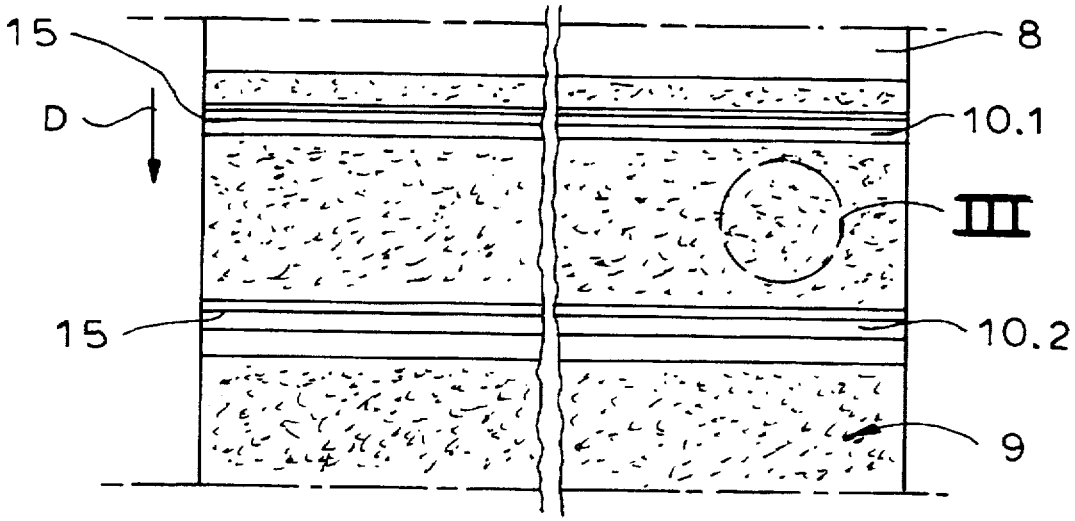
FIG. 2 is a larger-scale section taken along line II—II of FIG. 1.

According to the invention the side walls of the shaft 4 are each provided immediately below the slots 11 with a horizontally extending and open slot inlet 10.1 (see also FIG. 2) and somewhat therebelow at the upper portion of the diffuser region 9 with a similarly constructed slot outlet 10.2. Another blower 18 has an intake connected to the slots 10.2 and an output to the slots 10.1, and vanes 15 are provided in these slots 10.1 and 10.2 to vary the flow therethrough. The various air flows are regulated by a controller 21 connected to the blowers 17 and 18 and to the flaps 15 to control the stochastic movement of the filaments 2 to produce a spun-bond mat of extremely uniform density, that is without hard or soft spots.

Figure 3:
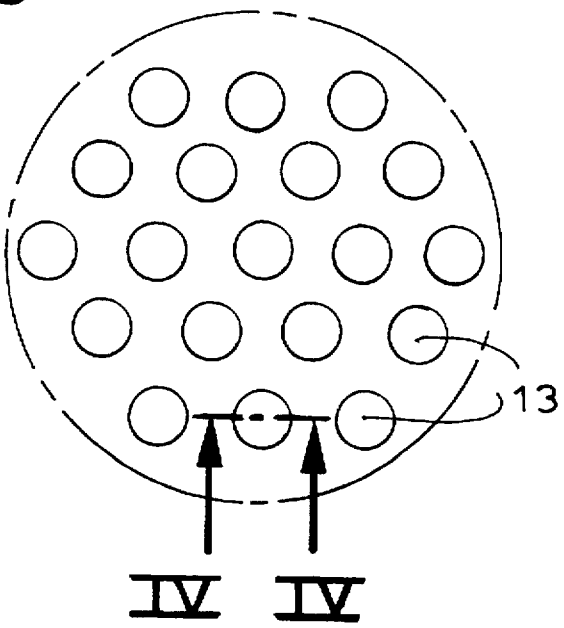
FIG. 3 is a large-scale view of the detail indicated at III in FIG. 2.
Figure 4:
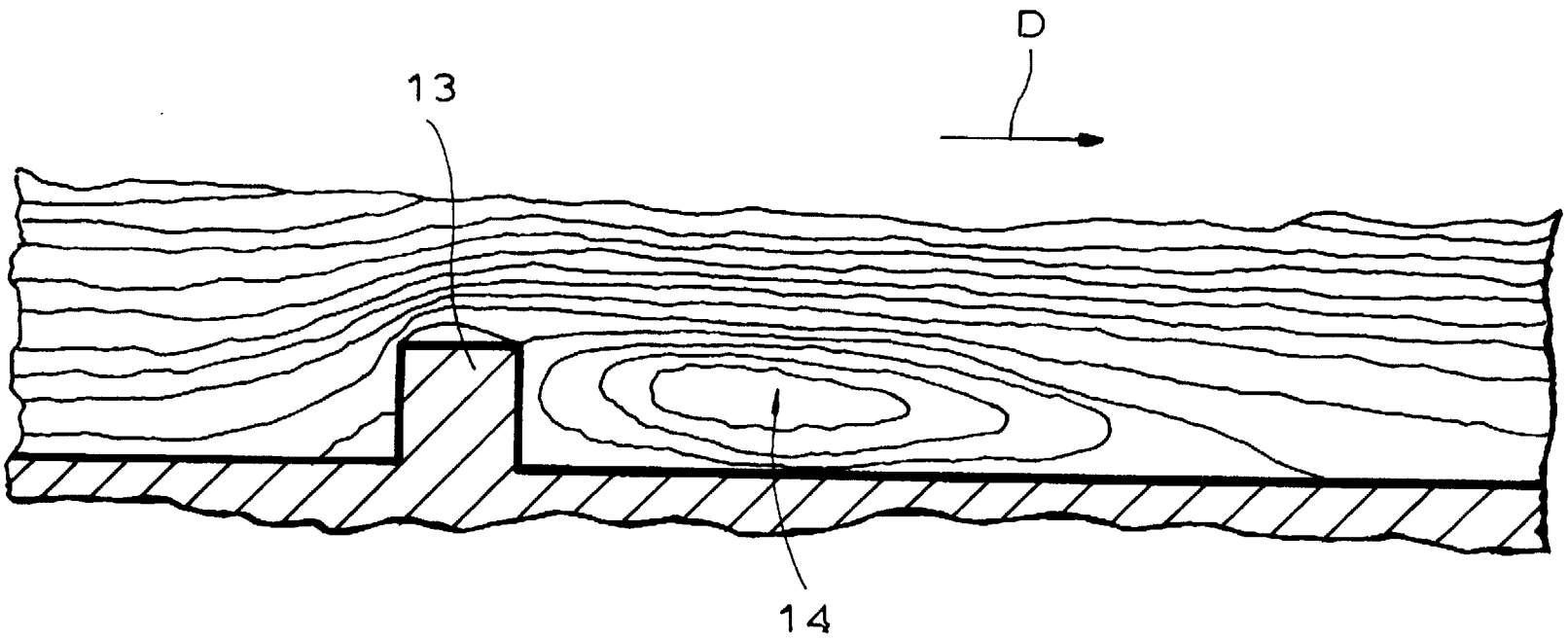
FIG. 4 is a large-scale section taken along line IV—IV of FIG. 3.

In addition as shown in FIGS. 3 and 4 the side and end walls of the shaft 4 are formed with flow deflectors 13, here in the form of small cylindrical bumps, that create tiny vortices 14 inhibiting contact of the filaments 2 with the walls of the shaft 4 and further making the movement of the filaments 2 uniform.

We claim:

1. A fleece-making apparatus comprising:

a vertically extending and horizontally elongated process shaft having upper and lower ends, a pair of spaced and generally parallel side walls, and a pair of spaced and generally parallel end walls bridging the side walls;

means including a nozzle head at the upper shaft end for emitting a multiplicity of continuous thermoplastic strands that descend in the shaft as a curtain;

means including a foraminous conveyor belt at and closing the lower shaft end for receiving and conveying away the filaments;

means for flowing a main stream of air from both sides of the nozzle head downward in the shaft from the upper shaft end to the lower shaft end and through the belt for cooling and stretching the filaments and depositing the filaments on the belt;

means including a pair of horizontally elongated and downwardly open second inlet slots flanking the curtain of filaments below the upper shaft end in the shaft between the side walls;

respective horizontally elongated third inlet slots in the side walls, directed horizontally toward each other, and flanking the curtain of filaments below the second slots;

respective horizontally elongated third outlet slots in the side walls and flanking the curtain of filaments below the third inlet slots and above the lower end, the side walls being substantially imperforate except at the slots and diverging downward below the third outlet slots, all the slots extending horizontally substantially a full length of the side walls of the shaft; and control means including at least one blower connected to the slots for directing second streams of air downward into the shaft from the second inlet slots, for introducing third streams of air horizontally into the shaft through the third slots generally perpendicular to the descending filaments, and for withdrawing air from the shaft through the third outlet slots for looping the cooled and stretched filaments prior to deposition on the belt.

2. The fleece-making apparatus defined in claim 1 wherein the third outlet slots open transversely into the shaft at the side walls, whereby a boundary layer of air is withdrawn through the third slots.

3. The fleece-making apparatus defined in claim 1 wherein the side walls are provided with inwardly projecting flow deflectors.

4. The fleece-making apparatus defined in claim 3 wherein the end walls are provided with further such inwardly projecting flow deflectors.

5. The fleece-making apparatus defined in claim 3 wherein the flow deflectors are formed as short cylindrical bumps.

6. The fleece-making apparatus defined in claim 1 wherein the control means further includes variable flow-obstructing vanes in the third slots for controlling flow therethrough.

* * * * *